US005242301A

United States Patent [19]

Hickey et al.

[11] Patent Number: 5,242,301

[45] Date of Patent: Sep. 7, 1993

[54] ALL PURPOSE DEVICE FOR DENTAL HYGIENE WITH DENTAL IMPLANTS

[76] Inventors: Catherine L. Hickey, 1184-A New Drennan Park, Fort Campbell, Ky. 42223; Michael Hardin, 133 Storybook Dr., Clarksville, Tenn. 37042; Judson S. Hickey, 1184-A New Drennan Park, Fort Campbell, Ky. 42223

[21] Appl. No.: 858,096

[22] Filed: Mar. 26, 1992

Related U.S. Application Data

[63] Continuation-in-part of Ser. No. 664,355, Mar. 14, 1991, abandoned.

[51] Int. Cl.[5] ..... A61C 3/00

[52] U.S. Cl. ..... 433/141; 15/167.1

[58] Field of Search ..... 433/141, 147; 132/308, 132/309, 310; 15/167.1, 167.2

[56] References Cited

U.S. PATENT DOCUMENTS

| | | | |
|---|---|---|---|
| 2,800,899 | 7/1957 | Barron | 128/62 |
| 4,538,631 | 9/1985 | Prince | 132/84 |
| 4,950,095 | 8/1990 | Picard | 401/181 |

FOREIGN PATENT DOCUMENTS

| | | |
|---|---|---|
| 680954 | 5/1930 | France . |
| 685019 | 3/1965 | Italy . |

*Primary Examiner*—Cary E. O'Connor
*Attorney, Agent, or Firm*—Edward D. Lanquist, Jr.; Mark J. Patterson; I. C. Waddey, Jr.

[57] ABSTRACT

An all purpose device for cleaning dental implant posts is disclosed. The device is provided with a brush angled and sized to effectively reach the rear of the implant posts, as well as the lingual side of the implant posts. In certain embodiments, a second brush which is a conventional toothbrush head is added to the end opposite the smaller implant post brush.

17 Claims, 3 Drawing Sheets

ALL PURPOSE DEVICE FOR DENTAL HYGIENE WITH DENTAL IMPLANTS

This is a continuation-in-part of copending patent application number 664,355 filed on Mar. 14, 1991, abandoned.

BACKGROUND OF THE INVENTION

The present invention relates generally to a dental cleaning device and more particularly to a device to clean the lingual surfaces of dental implant posts; the under surfaces of loaded prostheses on the implant posts; facial, distal, and mesial sides of the dental implant posts; and all exposed sides of a fixed partial denture or bridge.

It will be appreciated by those skilled in the art that osseointegrated dental implant systems have revolutionized the field of implantology. Implants are now routinely considered as an option in the treatment of partial and complete edentulism. Regardless of the implant system used, success is intrinsically dependent on the amount and quality of bone available at the implant site, the patient's health and cooperation, the design of the prosthesis, and ultimately the patient's ability to clean and maintain the implant post and prosthesis once in place.

Implants are surgically placed in a three-step procedure. First, surgical sites for the implant fixtures are selected, and the gingiva is incised and reflected back to expose the bone. Through a series of successively larger drills, a hole is prepared to receive the implant screw. Once in place, the screw is covered over with the gingiva and left in a healing stage for osseointegration to occur for approximately six months. The second stage entails the uncovering of the screws, placing abutment cylinders on the screws, and healing caps on top of the abutment cylinders. This stage heals for approximately four to six weeks. The third stage begins with the removal of the plastic healing caps and ends when the final prosthesis is screwed in place or loaded onto the abutment cylinders.

Dental implant posts (or abutments) and the prosthesis (or bridge) must be cleaned daily of plaque and food debris, or a process similar to periodontitis begins around the implant post, and the supporting bone is lost. This is also true of fixed partial dentures or true bridges which utilize teeth as their abutments.

Experience dictates that most all patients can clean the buccal or lip side and interproximal or right and left sides of the abutments adequately with a conventional toothbrush and periodontal aids. However, very few patients, if any, can adequately clean the lingual surfaces. The requirement for a toothbrush, which has the capability of cleaning all sides with relatively little complexity to the patient, becomes paramount.

The need for dental implants in the 1990's has been documented in recent government studies that indicated that there is a significant degree of edentulism (missing teeth) in the U.S. population. According to a 1985–1986 national survey of the oral health of the United States employed adults and senior citizens conducted by the National Institute of Dental Research, four percent of persons aged thirty-five to sixty-four years and forty-two percent of those over sixty-five years of age are totally endentulous. When this study was compared to a similar study conducted in 1971, the results of the comparison indicate that for the next few decades, there will be a significant number of individuals with compromised dentitions for whom implants may be indicated. With the heightened health consciousness of our society and the increased availability of dental health insurance plans, implants will become a reasonable alternative to removable prosthetic appliances. These implants provide an alternative that should enhance the quality of life during the senior years. It has been predicted that as many as 300,000 dental implants will be used on this population by the year 1992.

There are several types of implant systems available. These are classified according to their shape and position in the jaw. They include subperiosteal, transosteal, and endosseous implants. Each type of implant system must be cleaned to prevent failure of the system from bone loss caused by the same disease that causes tooth loss.

Patients with implants should be on a regular recall schedule to monitor the maintenance of the implant-supported prosthesis and their plaque control. Maintenance programs include radiographic evaluation, methods of plaque and calculus removal, and appropriate antimicrobial agents.

The average implant is approximately three-eighths to one-half inches tall. As a result, the neck of any periodontal aid should be capable of clearing the implant to reach the implant posts.

To date, patients have a variety of periodontal aids at their disposal to remove plaque from the abutments which include conventional toothbrushes, floss, super floss, interdental stimulators, toothpicks, interproximal brushes, and rubber tip stimulators to name a few These aids all work with varying degrees of success but are generally too bulky, too cumbersome, or virtually impossible to manipulate to effectively clean the lingual aspect (tongue side) of the abutment.

Several attempts have been made to provide toothbrushes and periodontal aids for use with the cleaning of implants. Unfortunately, all of these brushes are equipped with a conventional head, with a rectangular shape. The mouth and arches are formed in an ovoid shape, being rather constricted in the anterior regions of the jaw, especially on lingual surfaces. Whether there are teeth, bridges, or implants present in the front of the mouth, these conventional brush heads are oversized, poorly shaped and angled for effective use as periodontal aids.

Some brushes are bent at angles of approximately 20 to 30 degrees, similar to the angulation of dental mirrors. This angle does not permit effective cleaning because dental mirrors are angled for vision, not for cleaning ability. Further, the location of the bend in the brush, which is in the middle third of the brush, makes it inconvenient and uncomfortable to place a rectangular head behind the teeth without the handle being an obstacle.

One attempt to provide a device for implant cleaning is U.S. Pat. No. 4,941,227, issued to H. Sussman on Jul. 17, 1990. Sussman provides a horseshoe-shaped brush that is at a 90 degree angle from the handle. The horseshoe is open on the side of the brush away from the handle. This means that the opening is on the lingual side. However, the lingual surface is the hardest surface for patients to clean and the surface most neglected. This horseshoe-shaped brush would continue to neglect the lingual side. Further, the bristles surrounding the horseshoe wire are improperly aligned in relation to the brush. Because of its alignment, the circular shape of the bristles around the horseshoe wire would not fit into the angle created where the gums meet the teeth, bridges, and implants.

What is needed, then, is an all purpose device for effective dental hygiene with dental implants. This all purpose device must have a head that is properly sized and shaped to provide ready access to the lingual side of the implant posts as well as to the entire implant and posts. This cleaning device must be angled so that it can reach behind the lingual side of the implant post as well as the remaining sides of the implant. The device must provide dental hygiene for a periodontal patient The device must be flexible enough to provide for both effective cleaning of the lingual side of the implant posts as well as behind the implant and the implant posts. This device is presently lacking in the prior art.

SUMMARY OF THE INVENTION

The present device discloses a variety of all purpose devices for cleaning implant posts. Each of these devices has an implant brush that is aligned substantially perpendicularly from the handle to allow cleaning of the lingual side of the implant posts, as well as the remaining sides of the implant and implant posts. In certain instances, a buccal or standard toothbrush is used at the other end to allow the user a larger brush for cleaning other portions of the implant and teeth such as the facial, distal, and mesial sides. In certain embodiments, the device has one brush, while in others the device has two brushes. In certain embodiments, the handle is straight, while in others it is slightly bent. One embodiment has a brush at one end and a interdental stimulator at the other end.

Accordingly, one object of the present invention is to provide an all purpose device for cleaning implant posts.

Another object of the present invention is to provide a brush of proper size and shape to clean the lingual surfaces of the implant posts, as well as the remaining surfaces of the implant posts.

Still another object of the present invention is to provide a device angled to reach behind and on the lingual side of the implant posts.

Another object of the present device is to provide dental hygiene for periodontal patients.

Still a further object of the present invention is to provide a device that periodontal patients will use on a regular basis.

Still another object of the present invention is to provide a device that will improve the dental hygiene of all who use it.

DESCRIPTION OF THE PREFERRED EMBODIMENT

Figure 1:
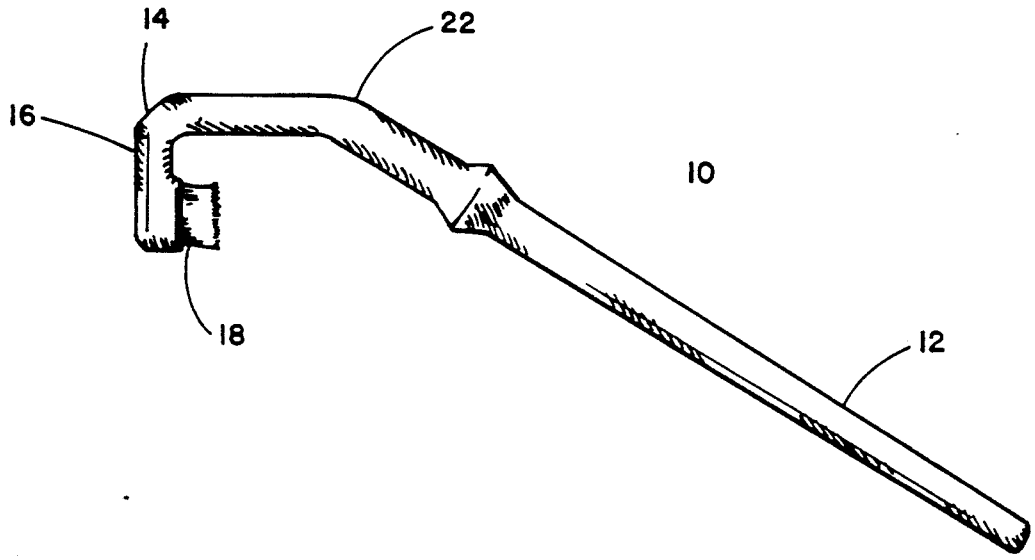
FIG. 1 is a side view of the device having a bent handle.

Referring now to FIG. 1, there is shown generally at 10 one embodiment of the all purpose device for dental hygiene for dental implants of the present invention. FIG. 1 is designed to clean the lingual surfaces of the dental implant posts and the under surfaces of the loaded prosthesis of the implant posts. Device 10 has handle 12. Handle 12 has a bend at substantially 20 to 30 degrees. At the distal end of handle 12, device 10 has a substantial right angle bend 14. After bend 14, device 10 has neck 16 Which joins bend 14 to implant post brush 18. To secure proper periodontal care, brush 18 must be placed from neck 16 at substantially a 90 degree angle.

Figure 2:
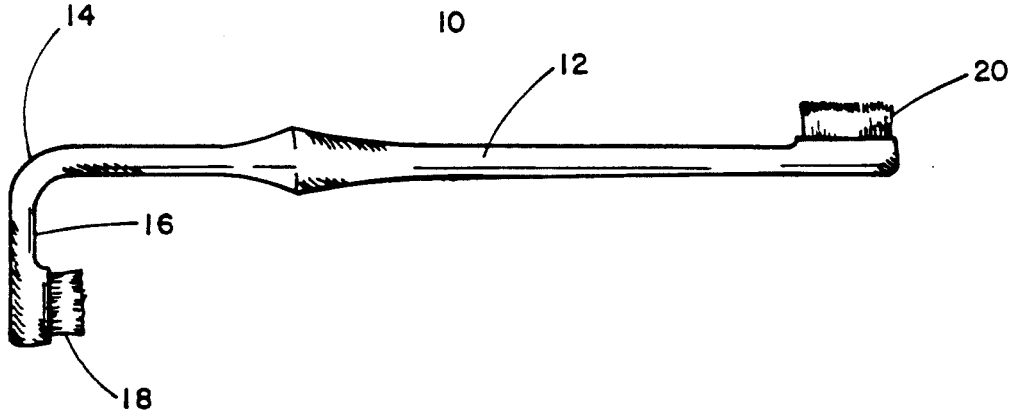
FIG. 2 is a side view of the all purpose device having a straight handle and standard toothbrush head.

Referring now to FIG. 2, there is shown generally at 10 another embodiment of the device 10 of the present invention. Device 10 has implant post brush 18 at one end and conventional toothbrush head 20 at the other. Between handle 12 and brush 18, device 10 has substantially right angle bend 14 and neck 16. In this particular embodiment of device 10, conventional toothbrush head 20 is placed to improve cleaning of the facial, distal, and mesial sides. The combination of brushes 18, 20, provides for improved cleaning of the lingual surfaces and both sides of a fixed partial denture, especially in an anterior bridge.

Figure 3:
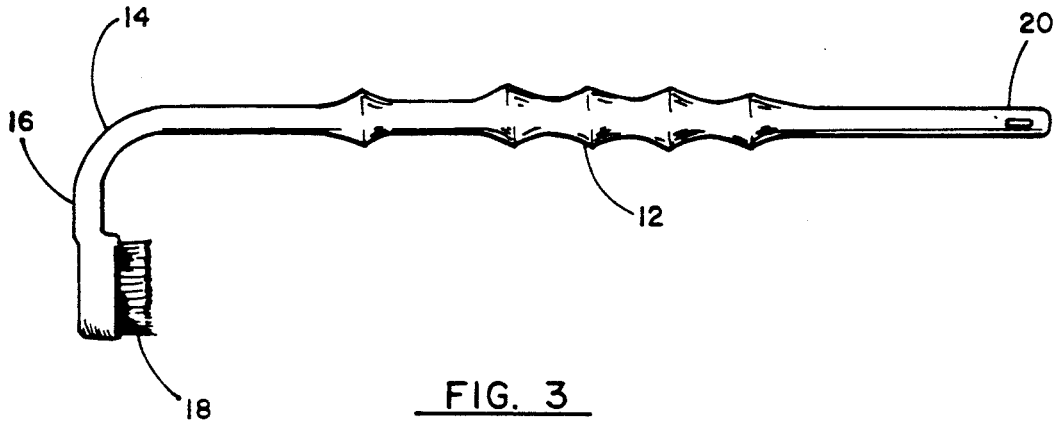
FIG. 3 is a side view of the all purpose device having a straight handle and an implant post brush.
Figure 3A:
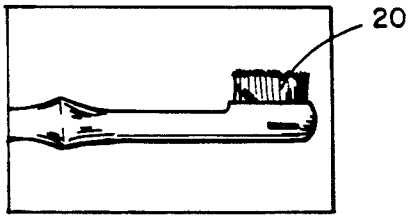
FIG. 3*a* is a partial side view of the all purpose device having a straight handle and an implant post brush.

Referring now to FIG. 3, there is shown generally at 10 still another embodiment of the present invention. Device 10 has handle 12. At one end of handle 12 there is shown substantial right angle bend 14. Between bend 14 and brush 18, there is neck 16. In the embodiment of FIG. 3, brush head 20 is retractable, as can be shown by comparing FIG. 3 with FIG. 3*a*. Retraction is achieved through any method known in the art.

Figure 4:
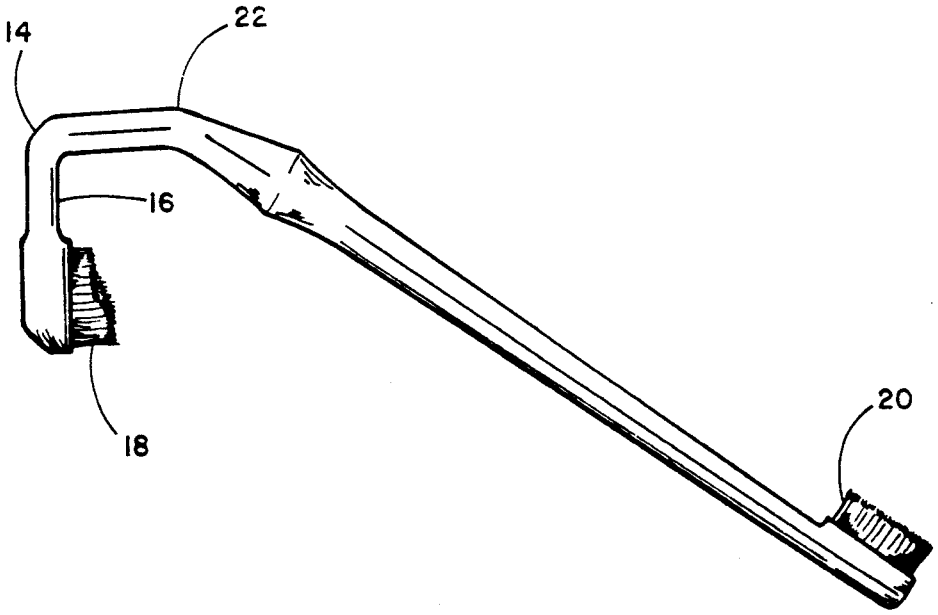
FIG. 4 is a side view of the all purpose device having a bent handle, an implant post brush, and a standard toothbrush head.

Referring now to FIG. 4, there is shown generally at 10 still another embodiment of the present invention. In this instance, implant brush 18 is placed at one end, while buccal brush 20 is placed at the other. Handle 12 has bend 22. Between bend 22 and brush 18 there is substantial 90 degree bend 14 and neck 16. Bend 22 allows better brushing of the lingual sides of the implant posts as well as other portions of the teeth and/or implant. Children seem to prefer this embodiment for cleaning their teeth, because of its ease in cleaning the lingual anterior areas in smaller sizes. Adults prefer the novelty of the shape of device 10 in all figures.

Conventional toothbrush head 20 is used at the end of device 10 away from brush 18 to clean the buccal surfaces of the abutments. In place of standard toothbrush head 20, an interdental stimulator can be attached at a 90 degree angle, so that it can be exposed or retracted in a manner similar to that of a Swiss army knife. Also, such an interdental stimulator can also be used in conjunction with and at the same end as conventional toothbrush head 20. The combination of these special periodontal aids enables the patient to clean the interproximal or right and left surfaces and the under surface of the prosthesis.

Device 10 in FIGS. 1–4 can be produced in a variety of ways. Initially, the handle could be formed in a plant similar to the manner in which a single toothbrush is created, except that the created toothbrush, in certain instances, would have two heads.

Device 10 of FIG. 1 can be created by taking a standard toothbrush and applying heat at bend 22 and 14.

The heat is applied until the handle can be bent and formed to the desired angle. The conventional head of the toothbrush is then ground off to form the substantially rectangular brush 18 that is desired in FIGS. 1–4.

Device 10 of FIG. 2 is created by taking one toothbrush and bending it to the desired angle to form angle 14. Brush 18 is then filed or ground off to the desired rectangular shape. A desired portion of the handle of the bent toothbrush is then cut off. A portion of a separate toothbrush is cut off. The two toothbrushes are then heated until melting and fused together by heat.

Device 10 of FIG. 3 can be made by taking one toothbrush and heating at the point of bend 14 to a bendable temperature. The desired portion of brush 18 is ground or cut away. Another toothbrush having retractable brushes is then fused to the handle of the bent toothbrush. As was true in FIG. 2, portions of the handles of each brush may need to be removed by cutting or breaking.

The device of FIG. 4 is made in a manner similar to that of FIG. 2, except that heat is also applied to bend 22.

Handle 12 of FIGS. 1–4 could also be provided with pistol grips or an enlarged handle to provide improved control of the toothbrush.

Figure 5:
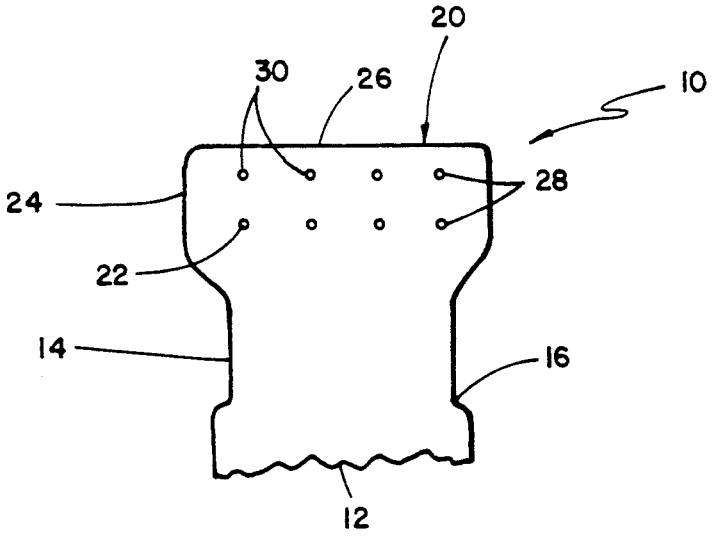
FIG. 5 is a end view of the all purpose device having two rows of bristles.

Referring now to FIG. 5 there is shown generally at 10 the two row embodiment of the present invention. In the preferred embodiment, tip 26 of head 20 is substantially three-eighths inches wide and side 24 is substantially three-sixteenths inches long. In the preferred embodiment, neck 14 is substantially three-eighths to one-half inches long from bottom of side 24 to right angle 16. In the preferred embodiment of this version, head to contains two rows 28 and four columns 30 of bristles 22 in the preferred embodiment of all versions, bristles 22 are substantially seven-sixteenths inches long.

Figure 6:
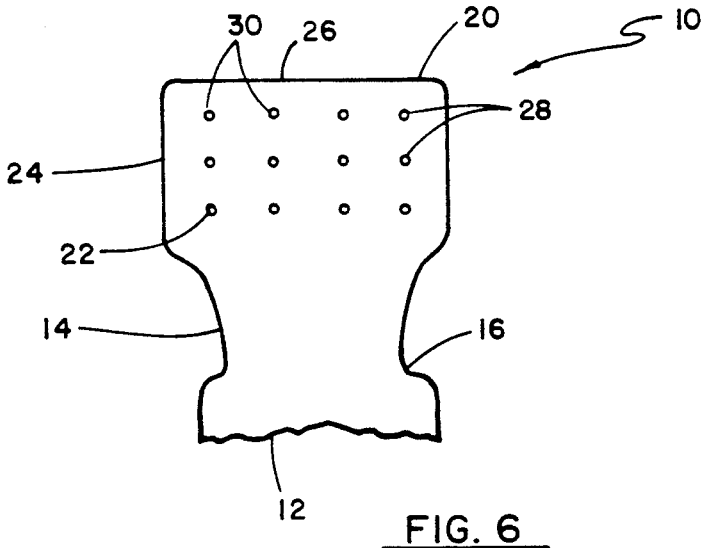
FIG. 6 is a end view of the all purpose device having three rows of bristles.

Referring now to FIG. 6 there is shown generally at 10 the three row embodiment of the present invention. In the preferred embodiment, tip 26 of head 20 is substantially three-eighths inches wide and side 24 is substantially one-quarter inches long. In the preferred embodiment, neck 14 is substantially three-eighths to one-half inches long from bottom of side 24 to right angle 16. In the preferred embodiment of this version, head 20 contains three rows 28 and four columns 30 of bristles 22.

Figure 7:
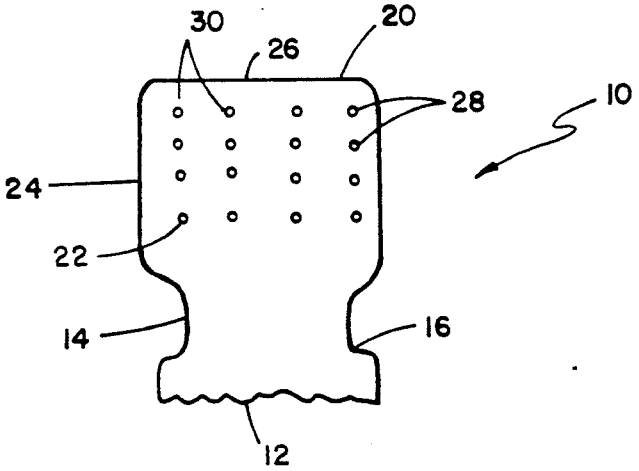
FIG. 7 is a end view of the all purpose device having four rows of bristles

Referring now to FIG. 7 there is shown generally at ID the four row embodiment of the present invention. In the preferred embodiment, tip 26 of head 20 is substantially three-eighths inches wide and side 24 is substantially three-eighths inches long. In the preferred embodiment, neck 14 is substantially three-eighths to one-half inches long from bottom of side 24 to right angle 16. In the preferred embodiment of this version, head 20 contains four rows 28 and four columns 30 of bristles 22.

Thus, although there have been particular embodiments of the present invention of a new and useful "All Purpose Device for Dental Hygiene with Dental Implants", it is not intended that such references be construed as limitations upon the scope of this invention, except as set forth in the following claims. Further, although there have been described certain dimensions used in the preferred embodiment, it is not intended that such dimensions be construed as limitations upon the scope of this invention, except as set forth in the following claims.

What I claim is:

1. An all purpose device for cleaning implants having an under surface comprising:

a. a substantially elongated handle;

b. a brush aligned substantially perpendicularly to said handle, said brush having a tip and a side;

d. a neck separating said handle from said brush enabling said implant brush to reach said undersurface of said implants, said neck being substantially one-half inches long; and d. a 90 degree bend joining said neck to said handle.

2. The device of claim 1 wherein said brush comprises:

a. two rows; and b. four columns.

3. The device of claim 2 further wherein said side is substantially one-quarter inches long.

4. The device of claim 1 wherein said brush comprises:

a. three rows; and b. four columns.

5. The device of claim 4 further wherein said side is substantially one-quarter inches long.

6. The device of claim 1 wherein said brush comprises:

a. four rows; and b. four columns.

7. The device of claim 6 further wherein said side is substantially three-eighths inches long.

8. device of claim 1 further wherein said tip is substantially three-eighths inches long.

9. The device of claim 1 further comprising a standard toothbrush head attached to said handle distally located from said implant brush.

10. The device of claim 1 wherein said handle comprises a second bend between said 90 degree bend and a distal end of said handle.

11. The device of claim 1 further comprising a standard toothbrush head attached to said handle, located distally from said implant brush.

12. The device of claim 1 further comprising an interdental stimulator attached to said handle.

13. An all purpose device for cleaning dental implant posts comprising:

a. an elongated handle;

b. an implant post brush located substantially perpendicularly from said handle, said post brush having a tip and a side;

c. a neck separating said handle from said brush enabling said implant brush to reach said undersurface of said implants, said neck being substantially one-half inches long;

d. a 90 degree bend joining said neck to said handle.

14. An all purpose device for cleaning dental implant posts comprising:

a. an elongated handle;

b. an implant post brush located substantially perpendicularly from said handle, said post brush having a tip, a side, and four columns of bristles;

c. a neck separating said handle from said brush enabling said implant brush to reach said undersurface of said implants, said neck being substantially one-half inches long;

d. a 90 degree bend joining said neck to said handle.

15. The device of claim 14 wherein said implant post brush means comprises two rows of bristles.

16. The device of claim 14 wherein said implant post brush means comprises three rows of bristles.

17. The device of claim 14 wherein said implant post brush means comprises four rows of bristles.

* * * * *